United States Patent [19]

Szabo

[11] Patent Number: 4,922,610

[45] Date of Patent: May 8, 1990

[54] BLADE HOLDER HAVING A MAGAZINE

[76] Inventor: Stephan L. Szabo, Untere Heslibachstrasse 16, CH-8700 Küsnacht, Switzerland

[21] Appl. No.: 268,790

[22] Filed: Nov. 9, 1988

Related U.S. Application Data

[63] Continuation-in-part of PCT CH88/0046 filed Feb. 26, 1988, published as WO88/06954 on Sep. 22, 1988.

[30] Foreign Application Priority Data

Mar. 10, 1987 [CH] Switzerland ..... 882/87

[51] Int. Cl.[5] ..... B26B 3/00

[52] U.S. Cl. ..... 30/125; 30/330

[58] Field of Search ..... 30/162, 330, 331, 335, 30/131, 125

[56] References Cited

U.S. PATENT DOCUMENTS

| | | | |
|---|---|---|---|
| 3,577,637 | 5/1971 | Braginetz | 30/162 |
| 3,927,473 | 12/1975 | Braginetz | 30/162 X |
| 3,983,595 | 10/1976 | Knudsen et al. | 30/162 X |
| 4,068,375 | 1/1978 | Rathbun et al. | 30/162 X |
| 4,575,936 | 3/1986 | Gringer | 30/330 X |

FOREIGN PATENT DOCUMENTS

| | | |
|---|---|---|
| 1948166 | 4/1970 | Fed. Rep. of Germany . |
| 2707458 | 8/1978 | Fed. Rep. of Germany . |
| 2402521 | 6/1979 | France . |

*Primary Examiner*—Douglas D. Watts

*Attorney, Agent, or Firm*—Watson, Cole, Grindle & Watson

[57] ABSTRACT

A conventional cutter is disclosed. It features a plate to secure the blade. There is also a blade magazine of relative conventional design.

14 Claims, 3 Drawing Sheets

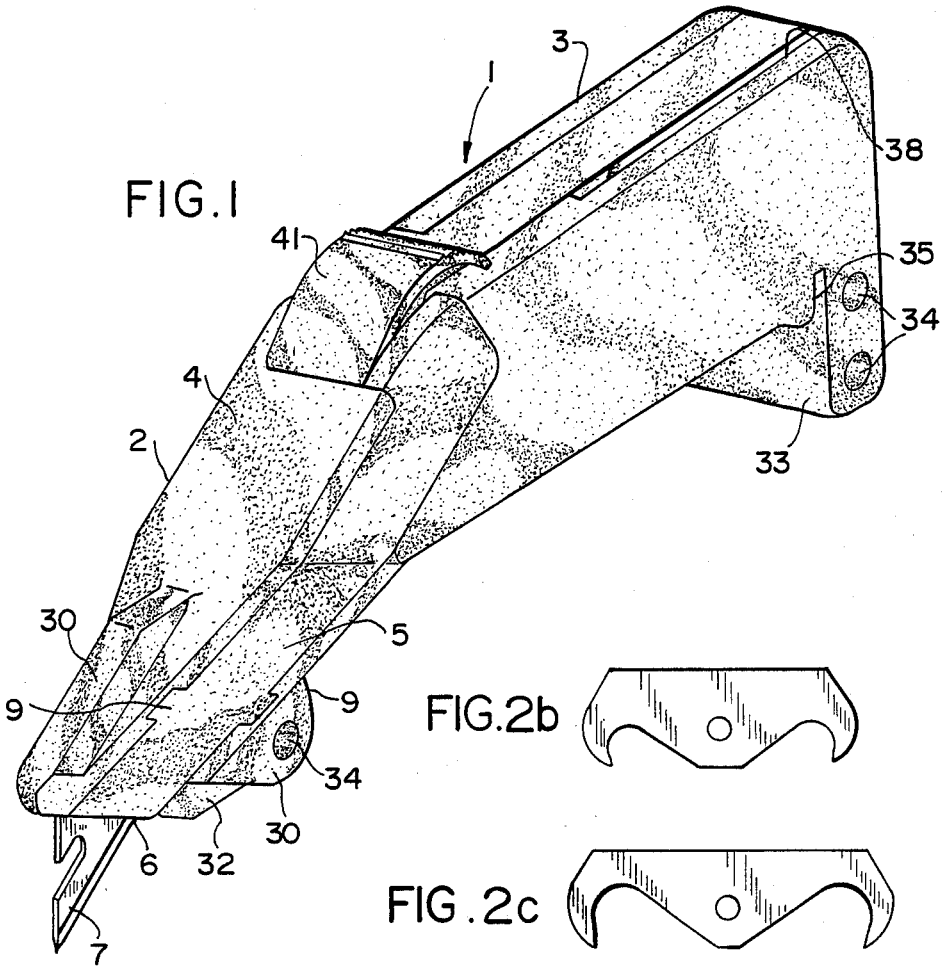
FIG. 1
FIG. 2b
FIG. 2c
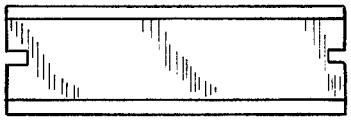
FIG. 2d
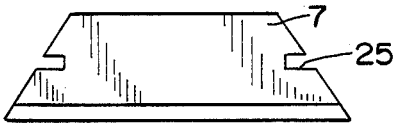
FIG. 2a
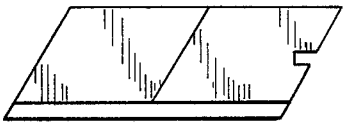
FIG. 2e
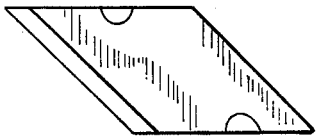
FIG. 2f

BLADE HOLDER HAVING A MAGAZINE

This application is a continuation-in-part application of PCT/CH88/00046, filed Feb. 26, 1988, published as WO88/06954 on Sept. 22, 1988, which in turn was based on Swiss Application No. 882/87-4, filed 10 Mar. 1987. Priority from the noted PCT application is requested under 35 U.S.C. 120 and 365(c), and priority from the noted Swiss application is requested under 35 U.S.C. 119 and 365(b).

The present invention relates to a cutter having a guiding slot at the front end of a cutter handle for guiding a blade which is retractable and extendable relative to the guiding slot and is clampable in its operating position.

Known cutters of this type generally serve as hand tool specifically for operations which demand an extremely sharp cutting edge at the blade such as, for instance, for cutting of wall-to-wall carpets or for similar work In such operations the cutting edge blunts relatively quickly such that the blade must be exchanged for a new one. In order to prevent the threat of injury by the sharp blade when the cutter is not in use, the blade must be able to be slid back completely into the handle of the cutter.

In known cutters of this type, the problem of exchanging blades has been solved in varying ways; I for example a cutter for use with elongated strip shaped blades is known from the DE-OS 28 27, blades of which comprise pre-punched breaking lines at regular intervals so as to be able to break off the frontmost blade end which has become unfit for use along a breaking line so that a sharp blade section is again present at the front end of the blade. The blade of this cutter which is contained in a blade magazine is pushed forward step-wise into the operating position by means of a blade slider, guided in the cutter handle and caught in notch positions, and clamped by means of a clamping bolt at the front end of the cutter in its operational position. This known cutter has the drawback that the length of the blade extending out of the cutter handle is not arbitrarily variable but merely that a rectilinear cutting edge is present at the blade which is dividable into individual blade sections due to the breaking lines present. However, quite differently shaped blades exist for the various working trades, specifically such as those used for cutting carpets where, for instance, blades which are shaped hook-like at both ends including a curvilinear cutting edge which allows the cutter to move in a pulling fashion through the material to be cut, specifically the carpet, and does not necessitate operation with exerting pressure as is the case of those blades having a rectilinear cutting edge. Thus, the cutter for the use of blades which can be broken off excludes the use of custom made blade designs.

Another cutter of above type is disclosed in the DE-OS 30 17 751 and comprises a blade magazine in a hollow cutter handle and which further includes a blade changing member guided extendably and retractably relative to the blade magazine and having various dogs which allow a used blade to be moved backwards out of the guide slot of the cutter into the blade magazine contained in the cutter handle and also to bring a new blade forwardly out of the blade magazine into the guiding slot. Thus, in this cutter, in the exchange of a used blade for a new one, a blade is not be grasped by hand at all so that the danger of injury is excluded completely because new and useless blades circulate in the cutter handle in which a supply of blades is contained in the blade magazine. The blade is moved back and forth in the guiding slot of the cutter by aid of a blade slider which is arrestable in various catch positions and is also arrested in the catch position in the guide slot such that it must be machined with a high precision. It is not possible to clamp any arbitrarily differently shaped blade in an operating position in the cutter handle and specifically at an arbitrary length of the extended blade length without any restriction by catch positions located at mutual intervals.

An object is therefore of this invention was to provide a cutter of the type mentioned above which is adaptable for use with vastly differently designed blades which can be clamped at the blade handle at an arbitrarily long extended length in the operating position which may be clamped independently from the guide slot laterally thereto a further object is to design the cutter relative to the operating technique of exerting pressure or by pulling such that it can be grasped more conveniently by hand and allows the execution of the various working techniques at less expenditure of force.

In order to achieve this object the cutter incorporates the features in accordance with independent claims and is furnished according to further suitable embodiments in accordance with the features set forth in the dependent claims.

Further advantages and details of the invention will become apparent from description and the drawings in which one embodiment of the subject of the invention is illustrated. These are illustrated in the drawings wherein FIG. 1 is a perspective view of a cutter according to the invention;

FIGS. 2–2*f* are views of a selection of six different blades for use with the cutter according to FIG. 1;

Figure 6:
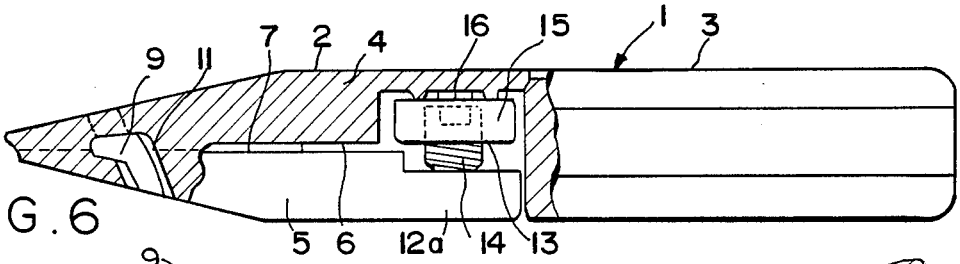
FIG. 6 is a partial sectional view through the cutter illustrating the principle of the clamping lever action.
Figure 7:
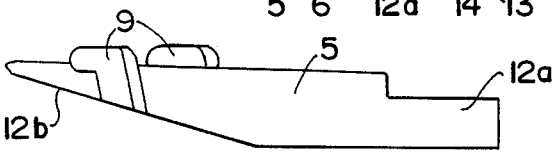
FIG. 7 shows the lever-like clamping piece as viewed from the narrow side in accordance with FIG. 6.
Figure 8:
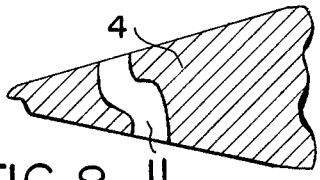
FIG. 8 is a partial section through the front end of the housing of the cutter.
Figure 11:
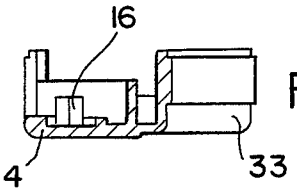
FIG. 11 is a cross-section of the housing of the cutter handle along line I—I of FIG. 10.

The cutter illustrated in perspective in FIG. 1 includes a cutter handle 1 which is designed offset such that a front section 2 and a rear section 3 connected integrally thereto form an obtuse angle. This offset design of the cutter handle 1 allows for a more favorable operating position of the cutter since the cutter can be grasped by the hand more comfortably than a rectilinear cutter. The cutter handle 1 includes in the front section 2 as well as in the rear section 3, a housing 4 as shown in FIG. 11, a substantially U-shaped cross-section. A clamping piece 5 is fitted in the front section 2 of the cutter handle 1 into the housing 4 having a U-shaped cross-section from its open side and which encloses between itself and the housing 4, a guiding slot 6 for a blade 7. The clamping piece 5 extends from the front end of the cutter handle upto the offset area of the cutter handle 1 between the front cutter handle section 2 and the rear cutter handle section 3. The forward terminal edge 8 of the front section of the cutter handle which includes the guiding slot 6 does not extend perpendicularly to the guiding slot 6 but rather extends at an acute angle to said guiding slot. The clamping piece 5 is designed as elongated lever. The clamping piece 5 illustrated separately in FIG. 7 includes at the upper and the lower longitudinal edge one respective angled bearing journal 9. The two bearing journals 9 which are arranged offset relative to each other are located on a straight line extending roughly parallel to the terminal edge 8 of the housing 4, which straight line forms a pivot axis 10 for the clamping piece 5 designed as lever (see FIG. 3). As can be seen best in FIGS. 6 and 8, the housing 4 includes recesses 11 which penetrate the front end completely and are located at a mutual distance which corresponds to the mutual distance between the two bearing journals 9. These recesses 11 extend in a step-like bent fashion through the housing 4 such that they form at the inside a bearing receipt for the two bearing journals 9 of the clamping piece 5 as best seen in FIG. 6. The completely penetrating recesses 11 can also be seen in FIGS. 3 and 4. The clamping piece 5 designed as lever comprises a longer lever-end 12*a* and a shorter lever end 12*b*.

Figure 3:
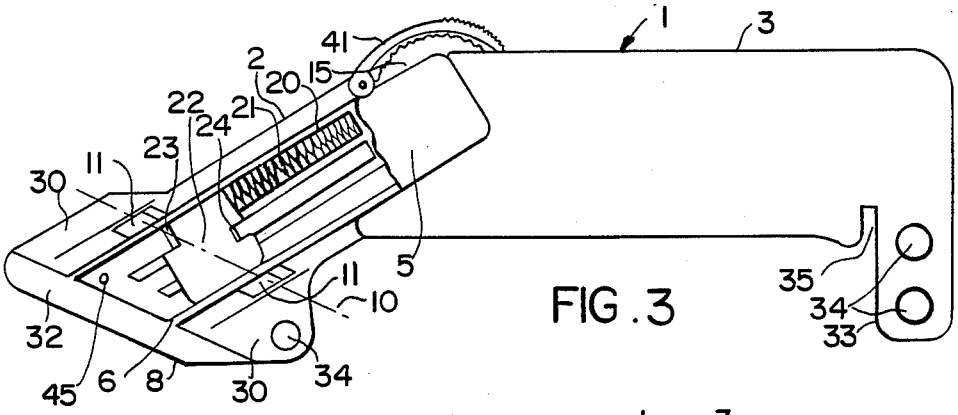
FIG. 3 is a side view of the cutter illustrated broken in the area of the clamping piece for the blade.

An operating screw 13 is located in the cutter handle 1 in the area of the offset between the front section 2 and the rear section 3 of the cutter handle and abut, against the clamping piece 5 and specifically abuts against its longer lever arm 12*a*. The screw 13 includes a knurled nut 15 threadingly engaging a bolt 14 having an external thread and of which the circumferential surface projects over the outer surface of the cutter handle allowing the operation thereof. At its face surface, the knurled nut 15 is supported in the housing 4 and the bolt 14 is held against rotation on a hexagonal stud 16 rigidly mounted to the housing 4 such that upon rotation of the knurled nut 15, the bolt 14 is shifted in axial direction and pivots the clamping piece 5. A small pivoting movement is sufficient to press the smaller lever arm 12*b* of the clamping piece 5 with a large force against the blade 7 for a clamping thereof in the guiding slot 6 of the cutter. The advantage of this type of clamping is that the blade 7 can be clamped in an arbitrarily long extended position if a sufficiently long portion of the blade is engaged by the clamping piece 5. Furthermore, most differently designed kinds of blades such as these illustrated for instance in FIGS. 2*a*–2*f* may be clamped without any difficulty in any arbitrarily long extended position. In order to obtain a completely safe clamping effect a hard metal pin 45 is arranged rigidly in a bore in the front section 2 of the cutter handle such as illustrated in FIG. 3. The pin 45 projects by its tip into the guiding slot 6 such that the blade 7 is pressed against this pin 45 when the blade is clamped by means of the clamping piece 5. The pin, which is pressed somewhat into the surface of the blade, prevents any slipping motion of the rigidly clamped blade. Finally, this type of a clamp mounting also allows clamping of a blade 7 laterally to the guide slot in a lying position such as illustrated in FIG. 10, which is not possible in any other cutter of this kind.

Figure 4:
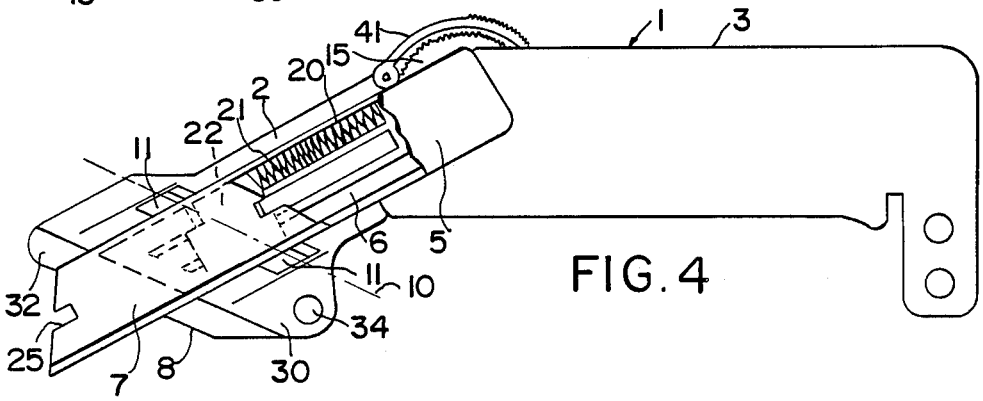
FIG. 4 is the same side view of the cutter as in FIG. 3 having a blade inserted.
Figure 5:
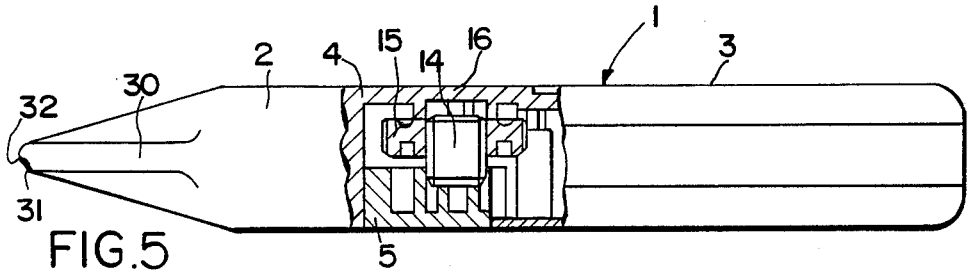
FIG. 5 is a view of a narrow side of the cutter, the area of the operating screw being shown in a cut open position.

The guiding slot 6 for the blade 7 which is enclosed by the housing 4 and the clamping piece 5 is provided with a groove shaped recess 20 formed in the housing 4. In this recess a spiral pressure spring 21 is located by means of which spring the not clampingly held blade 7 is forced out of the guiding slot if, for instance, it is to be exchanged (FIG. 3 and FIG. 4). The spring 21 presses against a flat coupling member 22 guided for longitudinal movement in the guiding slot and specifically presses an angular plate section 23 which is abutted by the end of the spring. A further plate section 24 bent upwardly out of the center of the edge of the flat coupling member 22 forms a pin which engages a recess 25 in the edge of the blade 7. By means of this coupling member 22, the blade 7 is precisely guided in the guiding slot 6 and prevents the cutting edge of the blade from being damaged. The coupled blade 7 is illustrated in FIG. 4.

Figure 10:
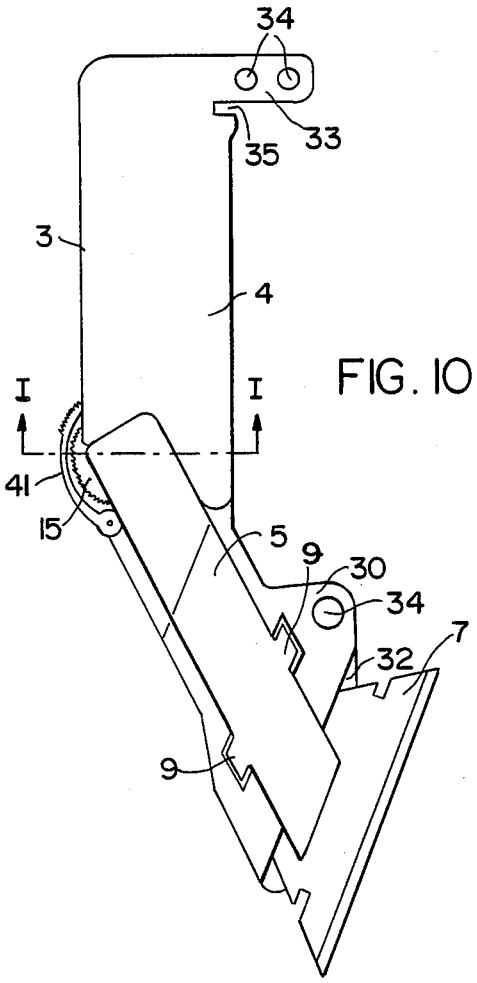
FIG. 10 is a side view of the cutter showing a sideways clamped blade.

In order to laterally clamp a lying blade in accordance with FIG. 10 relative to the guiding slot 6 by the clamping piece, a correspondingly long supporting surface is needed. To this end, the housing 4 includes, in the front section which comprises the guiding slot 6, rib-shaped housing widening sections 30 located at opposite housing sides. Furthermore, a stepped recess 31 is formed in this widened end of the housing by means of which a supporting surface 32 extending in the plane of the guiding slot 6 is formed and onto which a blade in accordance with FIG. 10 can be clamped. The rib-shaped housing widening sections 30 located at the bottom side provide at the same time, protection for the hand of the operator of the cutter so that the hand of the operator will not come into contact with the blade upon sliding of the cutter handle. A corresponding projecting housing part 33 for the protection of the hand of the operator is also located at the rear end of the cutter handle. Furthermore, lateral through bores 34 are formed in the projecting parts 30 and 33 of the housing and a receiving slot is additionally formed at the rear end of the housing which enables mounting of the cutter to a device not shown in the drawing and intended for mechanical type rectilinear guiding of the cutter. If the cutter is not guided manually but is instead mounted on such a device, a precise vertical cut can be achieved for instance when cutting wall-to-wall carpets and thus trimming of the pile at the right and left side of the cutting line can be avoided, which trimming may easily be required in case of a less precise manual guiding of the cutter. As a consequence less obvious work can be realized at the abutting carpet edges.

Figure 9:
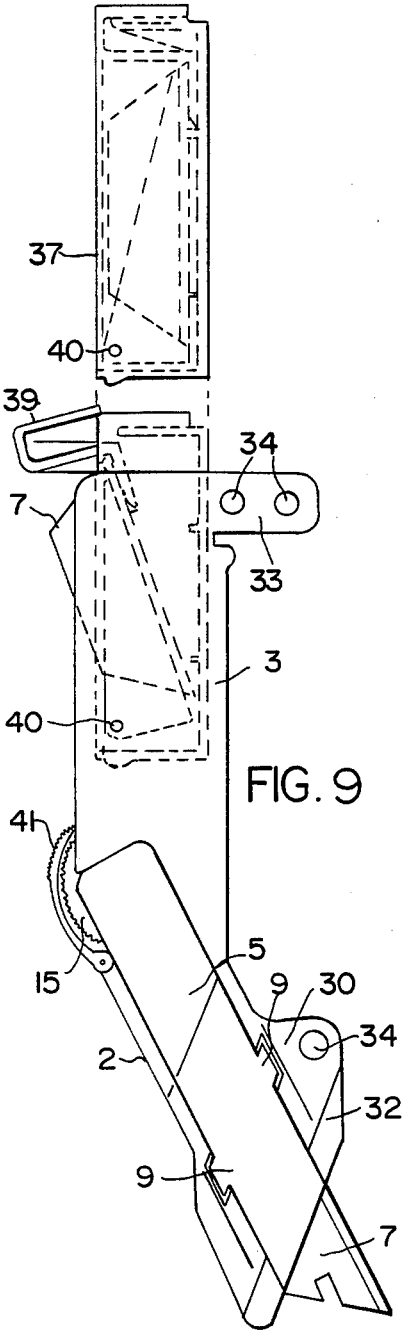
FIG. 9 is a side view of the cutter showing the blade magazine in the handle of the cutter.

In order to permanently have a sufficient supply of blades available for working with the cutter, a blade magazine 37 as shown in FIG. 9 is located in the rear hollow section 3 of the cutter handle 1 which contains a plurality of blades inserted from the rear narrow side of the cutter. In rear section 3, the housing 4 includes a slot 38 at the upper side for individual retrieval of one respective blade from the blade magazine. To this end, a lockable operating device is used which is pivotable around a pivot axis 40 in the blade magazine and on which one respective blade is supported at the bottom so as to be capable of being pivoted upwardly out of the slot 38.

In order to prevent accidental movement of the operating screw 13 used for clamping of the blade during work with the cutter, a pivotable protective flap 41 is located at the cutter handle housing 4 above the operating screw 13.

The cutter according to the invention has the advantage that, due to the offset design of the cutter handle, manipulation is much easier when working with the cutter, that many differing types of blades can be used and, in addition to the blades illustrated in FIG. 2, it is also possible to use saw blades having a width corresponding to the guiding slot 6, that the hand of the operator is protected during operation, and that, additionally, the cutter can be mounted onto an additional device capable of precisely guiding the cutter rectilinearly.

I claim:

1. A cutter comprising a handle, a blade within the handle and a guiding slot at the front end of the cutter handle for a guiding of the blade which is retractable and extendable relative to the guiding slot and is clampable in an operating position, wherein one section of the center handle is designed as a housing for the receipt of a clamping piece fitted thereinto such that the housing and the clamping piece enclose the guiding slot for the blade between themselves, the clamping piece being designed as lever which is pivotable about a pivot axis relative to the housing around bearing journals extending parallel to the guiding slot and held hinge-like at the housing by an operating screw acting on the longer lever end of the clamping piece, and supported in the housing and movable perpendicularly relative to the lever pivot axis, and clamps with the shorter lever end the blade held in the guiding slot formed by the housing and the clamping piece at the end of the housing.

2. A cutter in accordance with claim 1, wherein the cutter handle is shaped offset such that the section which includes the guiding slot and a section of the cutter handle which includes a blade magazine in the hollow cutter handle enclose an obtuse angle and that the section comprising the guiding slot of the cutter handle is shaped as housing having a U-shaped cross-section into the open side of which the clamping piece is fitted.

3. A cutter according to claim 1, wherein the operating screw for clamping of the blade within the cutter handle is located at a bent offset area between the section of the cutter handle containing the guiding slot and the section containing the blade magazine of the cutter handle and includes a knurled nut threadingly engaging a threaded bolt having an outer thread and of which a circumferential surface projects over the outer surface of the cutter handle for the operating thereof and is supported at its face in the housing and displaces upon an operating thereof the threaded bolt locked against rotation and abutting the end of the clamping piece in an axial direction.

4. A cutter in accordance with claim 1, wherein a spiral pressure spring for extending the blade out of the guiding slot is located in a groove-like recess of the guiding slot, said spring pressing against a coupling member guided for longitudinal movement in the guiding slot and in order to be coupled to the blade and for guiding thereof includes a laterally projecting pin for engaging an edge recess at the narrow side of the blade.

5. A cutter according to claim 1 wherein the section containing the guiding slot includes at its front end area at opposite sides rib-like housing widening section in which a step shaped recess for forming a supporting surface extending in the plane defined by the guiding slot is shaped at the front housing end, onto which the blade is clampable by means of the clamping piece lying laterally relative to the guiding slot.

6. A cutter according to claim 2, wherein the section of the cutter handle containing the blade magazine includes at its upper side a slot for removing one respective blade from the blade magazine as well as a lockable operating device at the end of the cutter handle for pushing one respective blade out of the slot.

7. A cutter according to claim 1, wherein the cutter handle comprises at the lower side enclosing the obtuse angle between its two sections at the outermost end of the section containing the blade magazine as well as at the outermost end of the section containing the guide slot, one respective housing section projecting at the lower side for a protection of the hand of the operator of the cutter.

8. A cutter according to claim 7, wherein the housing sections of the cutter handle projecting at the lower side thereof include lateral through bores and a receiving slot at one end of the cutter handle allowing mounting of the cutter to a device for a mechanical rectilinear guiding of the cutter.

9. Cutter according to claim 1, further comprising a hard metal pin arranged rigidly in a bore in said front section of said cutter handle and projecting with a tip into said guiding slot whereby said blade upon a clamping thereof is pressed thereagainst by said clamping piece.

10. A cutter comprising a handle, a blade at least partially within the handle and a clamping piece formed in the forward section of the cutter handle for clamping the blade between the forward end of a section of the cutter handle and the forward end of the elongated clamping piece, the clamping piece being hingedly connected like a lever to the section of the cutter handle by a hinge-like connection and provides a clamping force by being urged away from the section of the cutter handle remote from the clamping end, the forward end of the section of the cutter handle being shaped as a housing of substantially U-shaped cross-section which, together with the elongated clamping piece fitted into the housing, encloses a guiding slot for guiding the blade between extended and retracted positions within the guiding slot, the hinge-like connection being formed by two hook-shaped projections projecting at longitudinal edges at both sides of the guiding slot and extending into recesses in a wall of the housing to engage into the rear thereof, the clamping force being produced by an operating device located within the cutter handle at an inner wall of the clamping piece, the operating device including a threaded bolt lockable against rotation and movable in a direction perpendicular to the axis of rotation of the lever, and a nut rotatable thereon.

11. A cutter in accordance with claim 10, further including a spiral pressure spring for extending the blade out of the guiding slot which is located in a groove-like recess of the guiding slot, the spring pressing against a coupling member guided for longitudinal movement in the guiding slot which includes a laterally projecting pin engaging an edge recess at the narrow side of the blade.

12. A cutter in accordance with claim 10, wherein the section of the cutter handle containing the guiding slot includes, at its forward end area at opposite housing sides, rib-like housing widenings in which a step-shaped recess is formed at the forward end of the housing for forming a supporting surface extending in the plane of the guiding slot on which the blade is clampable by means of the clamping piece lying laterally relative to the guiding slot.

13. A cutter in accordance with claim 10, wherein the cutter handle comprises, at its lower side enclosing an obtuse angle between two sections at the outermost end of the section including a blade magazine as well as the outermost end of the section including the guiding slot, one respective housing section projecting at the lower side for the protection of the hand of an operator of the cutter.

14. A cutter in accordance with claim 13, wherein the housing sections projecting at the lower side of the cutter handle include lateral through bores and a receiving slot at one end of the cutter handle which allows mounting of the cutter to a device for a mechanical rectilinear guiding of the cutter.

* * * * *